United States Patent [19]

Goncalves

[11] Patent Number: 4,792,062

[45] Date of Patent: Dec. 20, 1988

[54] PACKAGE FOR TWO PRESSURIZED RECEPTACLES

[75] Inventor: Antonin Goncalves, Groslay, France

[73] Assignee: L'Oreal, Paris, France

[21] Appl. No.: 47,122

[22] Filed: May 8, 1987

[30] Foreign Application Priority Data

May 9, 1986 [FR] France ..... 86 06693

[51] Int. Cl.[4] ..... B65D 83/06

[52] U.S. Cl. ..... 222/135; 222/145; 222/402.13; 239/353

[58] Field of Search ..... 239/304, 337, 353, 424.5; 222/129, 135, 145, 182–183, 206, 211–212, 325, 330, 394, 402.1, 402.13, 402.15, 405, 483–485, 487, 131

[56] References Cited

U.S. PATENT DOCUMENTS

| | | | |
|---|---|---|---|
| 3,211,384 | 10/1965 | Seaquist | 239/337 X |
| 3,425,600 | 2/1969 | Abplanalp | 222/464 X |
| 3,433,418 | 3/1969 | Hach, Jr. | 239/424.5 X |
| 3,993,224 | 11/1976 | Harrison | 222/145 |
| 4,496,081 | 1/1985 | Farrey | 222/135 |

FOREIGN PATENT DOCUMENTS

| | | | |
|---|---|---|---|
| 818036 | 8/1951 | Fed. Rep. of Germany | 239/424.5 |
| 2039370 | 2/1972 | Fed. Rep. of Germany . | |
| 2325512 | 12/1974 | Fed. Rep. of Germany . | |
| 3247569 | 6/1983 | Fed. Rep. of Germany . | |
| 1148332 | 12/1957 | France . | |
| 1407940 | 7/1965 | France . | |
| 1413164 | 8/1965 | France . | |

*Primary Examiner*—Michael S. Huppert

*Attorney, Agent, or Firm*—Cushman, Darby & Cushman

[57] ABSTRACT

A package for two pressurized receptacles of the aerosol can type comprises a cylindrical enclosure of oval cross-section; a rider joining the two valve cups thereof; and a dispensing member comprising an actuation region and two outlet orifices, each connected to one of the two valve outlets by a channel provided in the dispensing member. The actuation region comprises two conduits each defining at least one part of one of the two channels feeding the orifices and slidable inside a duct carried by the rider; each duct is arranged opposite a dispensing valve carried by one of the valve cups; and each of the conduits actuates opening of the corresponding valve by sliding of its associated duct under the effect of a movement of the actuation region by a force exerted by a user. The package may be used for two products which are not to be mixed until the time of use.

5 Claims, 1 Drawing Sheet

PACKAGE FOR TWO PRESSURIZED RECEPTACLES

FIELD OF THE INVENTION

The present invention relates to a package for two pressurized receptacles permitting the materials packaged in these two receptacles to be dispensed simultaneously. In particular, these receptacles may be of the aerosol can type.

PRIOR ART

Packages for two pressurized receptacles are already known. These packages most frequently comprise a chamber in which the materials emerging from the two receptacles are mixed, the mixture produced being then dispensed through a single orifice. This state of the art, is illustrated by FR-A-No. 1,413,164 which relates in particular to a package for two aerosol cans. This package comprises an outer receptacle in which are situated the two aerosol cans, each fitted with a valve, while a cap ensures that the assembly is fastened to this receptacle. A dispensing head crowns this receptacle and may comprise two channels, each in communication with one of the aerosol cans and opening into a mixing chamber. The mixture produced leaves this chamber through a single orifice. However, this dispensing head may also comprise two separate channels, each connected to the valve of an aerosol can and opening outside through separate orifices. These orifices may, for example, be situated one above the other, or may be concentric if the two aerosol cans are comprised one in the other, their valves in this case also being concentric.

A package of this kind, like the majority of those of the prior art, has some disadvantages: in particular, it does not permit the two aerosol cans in the receptacle to be replaced, since the cap is crimped onto this receptacle; in addition, there is a risk of losing the dispensing head, as this is removable.

OBJECTS OF THE INVENTION

Consequently, it is an object of the present invention to provide a package for two pressurized receptacles which, on the one hand, permits the two receptacles included in the package to be easily replaced and, on the other hand, permits the dispensing head of the package to be integrally fastened.

Another object of the present invention is to provide a package of this type, which can be readily produced by moulding, at very low cost.

SUMMARY OF THE INVENTION

These objects, together with others which will become apparent hereinafter, are met by a package for two pressurized receptacles of the aerosol can type, each of these receptacles comprising a cylindrical body whose upper part is closed with a valve cup carrying a dispensing valve, the pressurized receptacles being substantially equal in height, this package comprising, firstly, a cylindrical casing of oval cross-section, which surrounds the bodies of these receptacles, secondly, a rider which joins the two valve cups of these receptacles and, thirdly, a dispensing member which comprises an actuation region and two outlet orifices, each of these two orifices being connected to one of the two valve outlets via a channel arranged in the dispensing member, said package being, according to the present invention, characterized in that the base of the dispensing member is integrally fastened to the enclosure, the dispensing member comprising at least one deformable region which connects this base to an actuation region, this actuation region comprising two conduits, each of which defines at least one part of one of the two channels feeding the orifices, each of these conduits being capable of sliding inside a duct carried by the rider, each duct being arranged opposite a dispensing valve carried by one of the valve cups, each of the conduits being capable of opening the valve opposite which it is situated by sliding in its associated duct under the effect of a movement of the actuating region due to the action of a user.

The base of the dispensing member is preferably integrally fastened to the enclosure by a snap connection. Similarly, the rider is snap-fitted onto the valve cups of the two receptacles.

Advantageously, the valve of each receptacle is a valve with a protruding stem, while the conduit which is associated with it crowns the protruding stem of the valve, and this stem abuts against an annular recess formed in the region of the connection of the channel of this conduit with a counterbore enabling the valve stem to be inserted.

The dispensing member preferably comprises, on the one hand, a hood whose base is snap-fastened onto the enclosure, this hood comprising, firstly, the conduits whose channels open into the same bore which is open to the outside and, secondly, the actuation region and, on the other hand, a dispensing end-piece consisting, firstly, of a plate comprising the two orifices and bearing on the periphery of the external opening of the bore of the hood and, secondly, of a tube which is substantially coaxial with the bore of the hood, in which it is housed, a space existing between the wall of this tube and that of the bore, the space communicating with one of the orifices in the plate and with one of the channels of the conduits, while the interior of the tube is in communication with the other orifice of the plate and with the other channel.

According to the preferred embodiment of the invention, the two orifices are substantially concentric, the first, or central, orifice being circular and the second, or peripheral, orifice consisting of several segments of the same annulus.

Advantageously, the peripheral orifice consists of two annular ring segments which are symmetrical in relation to the central orifice.

BRIEF DESCRIPTION OF THE DRAWINGS

The description which follows and which is not intended to imply any limitation should be read in the light of the attached Figures, in which.

DESCRIPTION OF THE PREFERRED EMBODIMENT

Figure 1:
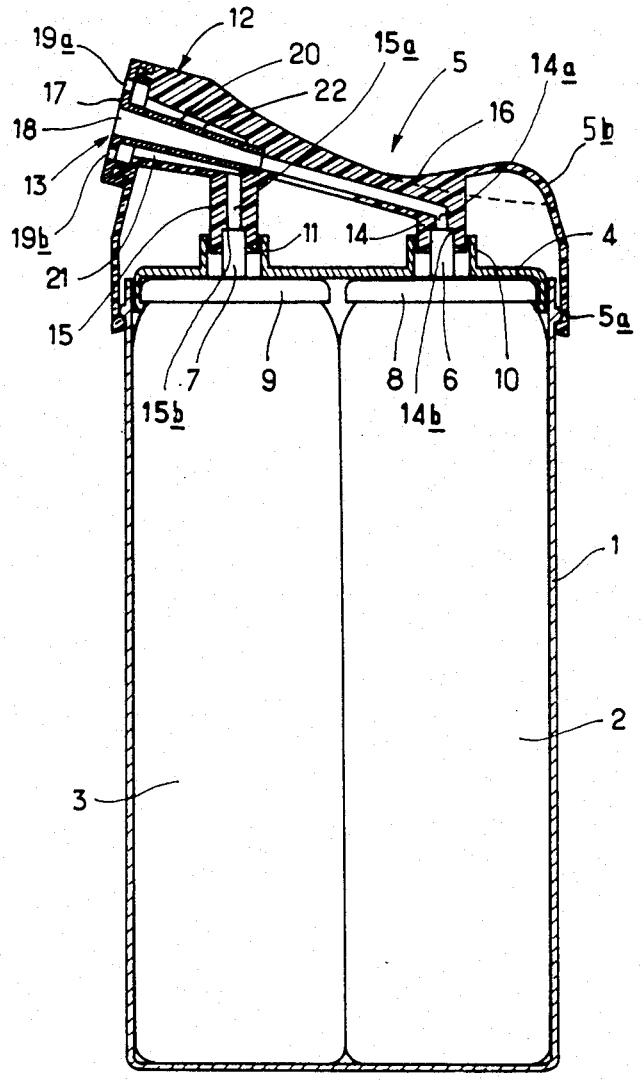
FIG. 1 is a view in vertical section along the line I—I of FIG. 2 of a package according to the present invention for two aerosol cans, the two pressurized receptacles not being sectioned.
Figure 2:
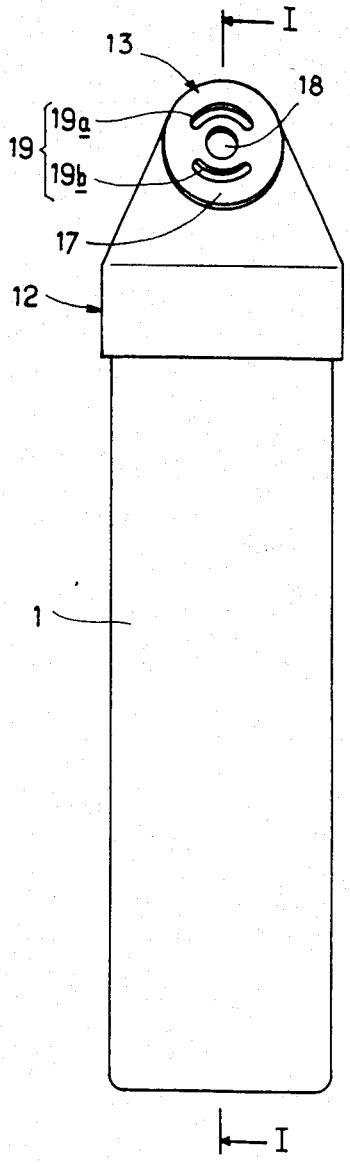
FIG. 2 is a front view of the package of FIG. 1.

With reference to the drawing, it can be seen that a package according to the present invention comprises, firstly, an enclosure 1 of oval cross-section surrounding two pressurized receptacles 2 and 3 of the aerosol can type, secondly, a rider 4 and, thirdly, a dispensing member 5.

The rider 4 joins the two valve cups 8 and 9 of these receptacles 2 and 3 on which it is held in position by snap fastening. Since the valve of each receptacle 2 and 3 is a valve with a protruding stem 6 and 7 respectively, this rider 4 also comprises two ducts 10 and 11 which are coaxial with these valve stems 6 and 7 respectively.

The dispensing member 5 comprises an actuation region 16 and two outlet orifices 18 and 19, each of which is connected to one of the two protruding stems 6 and 7 via a channel 14*a*, 15*a*, respectively, provided in the same dispensing member 5. The base 5*a* of the dispensing member 5 is integrally fastened to the enclosure 1 by snap-fastening.

The dispensing member 5 also comprises at least one deformable region 5*b*, which connects its base 5*a* to the actuation region 16, which comprises two conduits 14 and 15, each of which defines at least one part of one of the two channels 14*a* and 15*a* feeding the orifices 18 and 19. Each of the channels 14 and 15 can slide inside the duct 10 and 11 respectively, which is carried by the rider 4: as will have been previously understood, each duct 10 and 11 is thus situated opposite a dispensing valve carried by one of the valve cups 8 or 9. Each of the conduits 14 and 15 can cause the opening of the valve opposite which it is situated, by sliding in the associated duct 10 or 11 under the effect of a movement of the actuation region 16 due to the action of a user.

The conduit 14 or 15 which is associated with the protruding stem 6 or 7 of a valve crowns this protruding stem 6 or 7, which abuts against an annular recess 14*b* or 15*b* formed in the region of the connection of the channel 14*a* or of the channel 15*a* of this conduit with a counterbore which permits the protruding stem 6 or 7 to be inserted.

The dispensing member 5 comprises, on the one hand, a hood 12 and, on the other hand, a dispensing end-piece 13. The base 5*a* of the hood 12 is snap-fastened onto the enclosure 1 and comprises, firstly, the conduits 14 and 15 whose channels 14*a* and 15*b* open into the same single bore which is itself open to the outside and, secondly, the actuation region 16. As for the dispensing end-piece 13, this consists, firstly, of a plate 17 which comprises the orifices 18 and 19 and bears on the periphery of the external opening of the bore of the hood 12 and, secondly, a tube 20 which is substantially coaxial with this bore, in which it is housed; a space 21 exists between the wall of this tube 20 and that of the bore. The space 21 is in communication with one of the orifices 19 in the plate 17 and with one of the channels 15*a* of the conduits 14 and 15, while in the present embodiment the interior of the tube 20 is in communication with the other orifice 18 in the plate 17 and with the other channel 14*a*.

Figure 3:
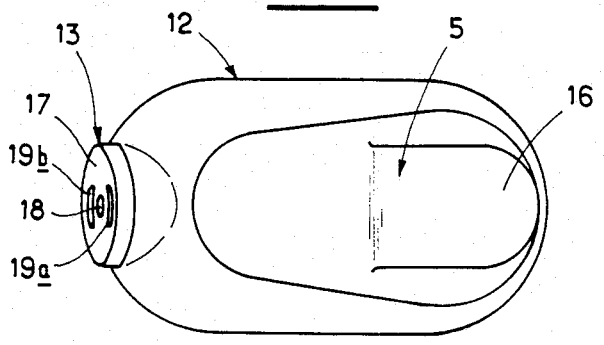
FIG. 3 is a top view of the package of FIG. 1.

The plate 17 is planar and situated at one end of the long diameter of the oval defined by the enclosure 1, the actuation region 16 being situated substantially at the other end of this same long diameter, as can be seen in FIG. 3.

The two orifices 18 and 19 are substantially concentric: the first, or central, orifice 18 is circular and in communication with the tube 20, the second, or peripheral, orifice consists of two segments 19*a* and 19*b* of the same single annulus, which ar symmetrical in relation to the central orifice 18 and in communication with the space 21.

When the user presses the actuation region 16, he simultaneously exerts a pressure on each protruding valve stem; consequently, he causes an ejection of a quantity of material held in each aerosol can 2 and 3. In the exemplary embodiment shown in the Figures, the material held in the aerosol can 2 is ejected outwards through the central orifice 18 after having passed through the conduit 14 and the tube 20 while that held in the aerosol can 3 is ejected outwards through the two annular segments 19*a* and 19*b* after having passed through the conduit 15 and the space 21; both these materials will therefore be ejected without having any possibility of mixing upstream of the plate 17. The mixture of both these materials can, in fact, be produced only beyond this plate.

A package of this kind is of particular interest when one of the products is in the form of a gel and the other in the form of a foam; in this case, that which is in gel form will be ejected through the central orifice 18, whereas the other will be ejected through the peripheral orifice 19. It is also possible to use a package of this kind for two complementary materials such as a colouring material and an oxidizing agent for hair-dyeing. This package may also be employed when the materials held in the two pressurized receptacles 2 and 3 are reactive components for forming a glue. The absence of a mixing chamber avoids the complete blockage of the dispensing device and even enables it to be readily cleaned.

I claim:

1. In a package for first and second pressurized receptacles of the aerosal can type, each of said first and second receptacles comprising a cylindrical body whose upper part is closed by a valve cup carrying a dispensing valve having an outlet, and said pressurized receptacles being substantially of equal height, said package comprising:

(a) an enclosure of oval cross-section surrounding the bodies of said receptacles;

(b) a rider which joins the two valve cups of said receptacles; and (c) a dispensing member having a base and comprising an actuation region, and means defining first and second outlet orifices and first and second channels in said dispensing member, said first channel being connected to said first valve outlet and to said first outlet orifice and said second channel being connected to said second outlet orifice and to said second valve outlet, the improvement wherein (d) the base of the dispensing member is integrally fastened to the enclosure;

(e) the dispensing member comprises at least one deformable region which connects said base to said actuation region;

(f) said actuation region comprises first and second conduits, each of which defines at least one part of a respective one of said first and second channels connected to the outlet orifices;

(g) each of said first and second conduits is slidably received inside a duct means carried by said rider;

(h) each said duct means is arranged opposite a respective one of said first and second dispensing valves; and (i) each of said first and second conduits is arranged to open the said dispensing valve opposite which it is situated, by sliding in its associated duct means under the effect of a movement of the actuation region imposed by a user;

said base of said dispensing member being integrally fastened to the closure by a snap-fastening.

2. A package according to claim 1, wherein the rider is snap-fastened onto the valve cups of the first and second receptacles.

3. A package according to claim 1, wherein the valve of said first receptacle and the valve of said second receptacle each have a protruding stem; wherein the respective one of the first and second conduits with which each said protruding valve stem is associated crowns the protruding stem of the valve; and wherein annular recess means if formed in the region of the connection of each said channel of the respective said conduit with a counterbore enabling the stem to be inserted said stem of each said dispensing valve abutting the associated said annular recess.

4. A package according to claim 1, wherein the dispensing member comprises:

(a) a hood having said base of said dispensing member which is snap-fastened onto the enclosure, said hood comprising, firstly, said first and second conduits, said first and second channels of said dispensing member lying in a common single bore with said first and second conduits having respective channels open into said single bore open to the outside and, secondly, the actuation region; and (b) a dispensing end-piece comprising, firstly, a plate comprising said first and second outlet orifices and bearing on the periphery of the external opening of the bore of the hood and, secondly, of a tube which is substantially coaxial with the bore of the hood in which it is housed, there being a space between the wall of said tube and that of said bore, said space being in communication with one of said first and second orifices in the plate and with one of the first and second channels; and wherein the interior of said tube is in communication with the other of said first and second orifices in the plate and with the other of the said first and second channels;

said first and second outlet orifices being substantially concentric, said first orifice being circular and said second orifice comprising several segments of the same annulus surrounding said first orifice.

5. A package according to claim 4, wherein said second orifice consists of two segments of an annulus which is symmetrical in relation to the first orifice.

* * * * *